US008522830B2

(12) United States Patent
Barlasov et al.

(10) Patent No.: US 8,522,830 B2
(45) Date of Patent: Sep. 3, 2013

(54) TWO STROKE CRIMPING DEVICE

(75) Inventors: Pavlo Barlasov, San Jose, CA (US); Sergey Ivanovich Girchenko, Kharkiv (UA)

(73) Assignee: Teknika USA, Inc., San Jose, CA (US)

( * ) Notice: Subject to any disclaimer, the term of this patent is extended or adjusted under 35 U.S.C. 154(b) by 404 days.

(21) Appl. No.: 12/592,935

(22) Filed: Dec. 3, 2009

(65) Prior Publication Data

US 2011/0132058 A1 Jun. 9, 2011

(51) Int. Cl.
*B21F 9/02* (2006.01)

(52) U.S. Cl.
USPC ..... 140/93.2; 140/93.4; 140/153; 140/154; 72/409.11; 72/450

(58) Field of Classification Search
USPC ..... 72/409.01, 409.04, 409.07, 409.13, 72/409.19, 409.11, 450; 140/150, 152, 153, 140/154, 93.4, 93.2; 81/416; 264/175; 450/451; 12/592, 935
See application file for complete search history.

(56) References Cited

U.S. PATENT DOCUMENTS

| | | | | |
|---|---|---|---|---|
| 1,273,115 | A | 7/1918 | Brooks | |
| 1,784,213 | A | 12/1930 | Westphal | |
| 1,836,147 | A | 12/1931 | Wright | |
| 2,087,655 | A | 7/1937 | Prestwich | |
| 2,349,608 | A | 5/1944 | Bramble | |
| 2,375,769 | A | 5/1945 | Childress et al. | |
| 3,040,606 | A * | 6/1962 | Ericsson | 140/154 |
| 3,089,366 | A * | 5/1963 | Haraden | 140/154 |
| 3,112,543 | A | 12/1963 | Derrickson | |
| 3,189,060 | A | 6/1965 | Attas | |
| 3,211,186 | A | 10/1965 | Bushman | |
| 3,232,323 | A | 2/1966 | Dimmett | |
| 3,360,017 | A | 12/1967 | Vilcins | |
| 3,623,190 | A | 11/1971 | Karass | |
| 3,650,301 | A | 3/1972 | Karass | |
| 3,695,307 | A | 10/1972 | Kuoni | |
| 3,811,482 | A | 5/1974 | Back et al. | |
| 3,837,373 | A | 9/1974 | Beardsley | |
| 3,858,625 | A | 1/1975 | Banjeglav | |
| 4,015,643 | A | 4/1977 | Cheung | |
| 4,041,993 | A | 8/1977 | Angarola | |
| 4,056,128 | A | 11/1977 | Konrad | |
| 4,223,704 | A | 9/1980 | Glaus | |

(Continued)

OTHER PUBLICATIONS

Barlasov, Pavlo; U.S. Appl. No. 13/340,563; Filed: Dec. 29, 2011; "Method and Apparatus for Securing the Ends of Flexible Band With a Buckle".

*Primary Examiner* — Dana Ross
*Assistant Examiner* — Homer Boyer
(74) *Attorney, Agent, or Firm* — David Lewis

(57) ABSTRACT

A crimping device for securing a seal member onto overlapped end portions of a strap material includes at least a tool head, operating and stationary handles, two rows of crimping elements having at least a pair of shears and oppositely situated pair of jaws extended between the pair of shears. The crimping elements may be disposed in the tool head and connected with the handles so that at least one row of crimping elements crimps a seal while at least one row is idle when the handles move away from each other. In an embodiment, the handles can make an inward stroke only when a full jaw-closing outward crimping stroke is completed. At least one row of crimping elements crimps the seal with an inward movement of the handles while at least one previously actuated row of crimping elements is not involved in closing the seal.

6 Claims, 4 Drawing Sheets

(56) References Cited

U.S. PATENT DOCUMENTS

| | | | | |
|---|---|---|---|---|
| 4,252,158 | A | 2/1981 | McDade | |
| 4,282,907 | A | 8/1981 | Massion et al. | |
| 4,398,572 | A | 8/1983 | Fromm | |
| 4,561,475 | A | 12/1985 | Hinden | |
| 4,574,848 | A | 3/1986 | Bartzick et al. | |
| 4,684,125 | A * | 8/1987 | Lantz | 482/112 |
| 5,181,546 | A | 1/1993 | Synek | |
| 5,832,964 | A | 11/1998 | Joshi | |
| 5,975,150 | A | 11/1999 | Barlasov et al. | |
| 6,047,742 | A | 4/2000 | Barlasov et al. | |
| 6,152,188 | A | 11/2000 | Barlasov | |
| 6,553,632 | B1 | 4/2003 | Brumpton | |
| 7,121,307 | B2 * | 10/2006 | Nasiatka et al. | 140/153 |
| 7,748,415 | B2 | 7/2010 | Barlosov et al. | |
| 8,069,521 | B2 * | 12/2011 | Beck et al. | 15/88 |
| 2010/0287739 | A1 | 11/2010 | Elia | |

* cited by examiner

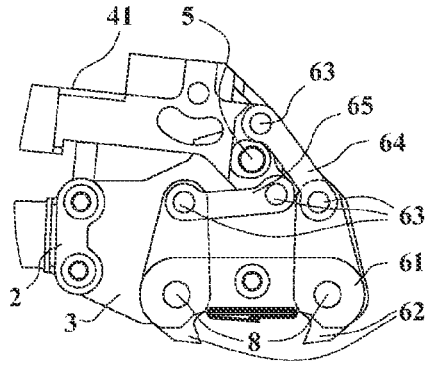
FIG. 3a
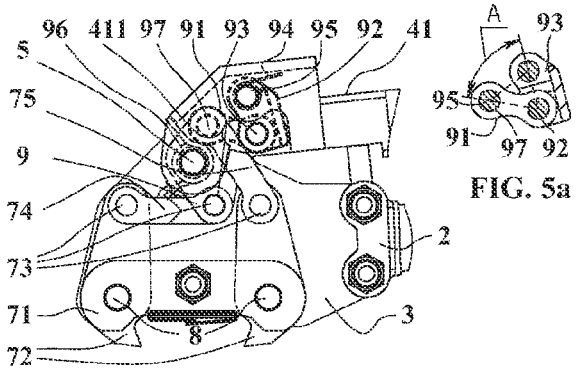
FIG. 4a
FIG. 5a
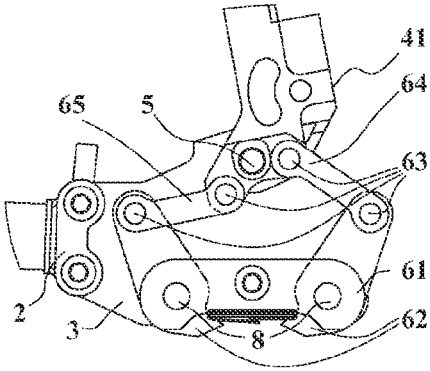
FIG. 3b
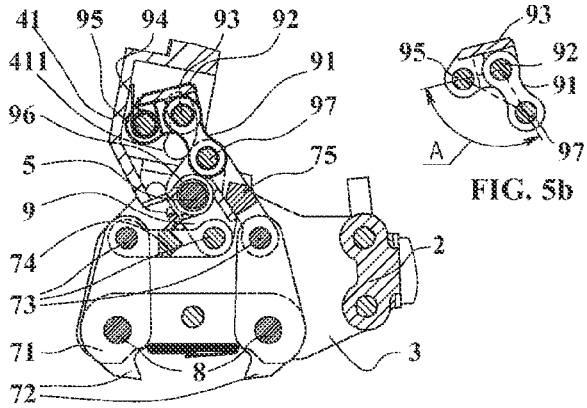
FIG. 4b
FIG. 5b
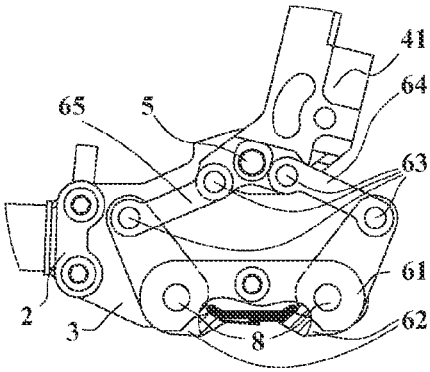
FIG. 3c
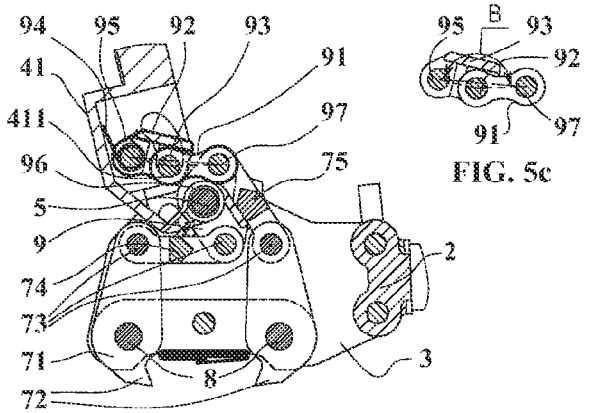
FIG. 4c
FIG. 5c

TWO STROKE CRIMPING DEVICE

FIELD

The present invention relates generally to banding equipment, and more particularly to crimping devices.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Banding tools are used to secure articles in a bundle, or to bind packages. After a band is tightened, the band is held in position by a metal seal that is crimped on the band. The band or strap material is typically metal or plastic. While metallic strapping has been used for banding all kinds of packages for a number of years, only recently has interest been shown in wide—more than ¾" (19 mm)—and thick—more than 3/64" (1.2 mm)—extruded non-metallic strapping. These straps that are more than ¾" (19 mm) wide and more than 3/64" (1.2 mm) thick have a very high tensile strength and resist dimensional change when placed around an object and tensioned.

Crimping of a metal seal on straps that are more than ¾" (19 mm) wide and more than 3/64" (1.2 mm) thick requires a substantial amount of force, and the current specification recognizes that it is highly desirable to reduce the amount of force necessary to crimp straps, thereby easing the effort necessary to operate the banding tool.

Some prior art devices may employ a two phase operation with one idle stroke and one working stroke that completes crimping action with an inward movement of the handles. There are also prior art two stroke operation devices that close the seal on both outward and inward crimping strokes but all rows of jaws are simultaneously involved in closing the seal and require energy for actuation. The prior art devices also have an action such that the operator can remove the tool from the strap even if the sealing action has not been completed so that there is a possibility that the incomplete seal may be weaker than specified or be otherwise imperfect.

SUMMARY OF THE INVENTION

A two stroke crimping device for securing a seal member onto overlapped end portions of strap material that requires less effort by the operator than a single stroke device is provided.

In an embodiment, the crimping device may include a tool head, pair of handles, at least two rows of crimping elements, which include at least a pair of shears and an oppositely situated pair of jaws extended between the pair of shear elements. In this specification, the terms jaws and crimping elements may be substituted for one another wherever they appear and wherever the substitution results in a sentence that makes sense to obtain different embodiments and/or statements of different scopes.

In an embodiment, the crimping tool includes at least two pairs of jaws. At least one pair of jaws opens and closes with the movement of one of the handles, while the other handle may remain stationary. As one handle moves away from the other handle, the first pair of jaws opens and as the handle moves towards the other handle the first pair of jaws closes. The other pair of jaws has two mechanical biases. One mechanical bias is so that when one of the two handles is moved in one direction, one pair of jaws closes, and when the same handle is moved in the opposite direction the other pair of jaws closes.

In an embodiment, the crimping tool includes at least a stationery handle mounted on the tool head and the operating handle is connected to at least two pairs of jaws (having crimping elements). One row of jaws is connected through a pair of linkages to the operating handle, and another row of jaws (having crimping elements) is connected to the operating handle through a pair of lock arms, the lever, and the second pair of linkages. These two connections of the jaws to the handle allow the handle to actuate each row of crimping elements independently.

One of the rows of crimping elements (a first pair of jaws is a part of the first row of crimping elements) crimps a seal during an outward stroke of the handles, as the handles move away from each other, and while the handles move away from each other, the second row of jaws does not move. At the end of outward stroke a pair of lock arms locks the lever. In an embodiment, the handles can make an inward stroke only after a full jaw-closing outward crimping stroke is completed. The first row of crimping elements move oppositely in a reverse direction during the inward movement of the handles, i.e. while the second row of jaws (crimping elements) crimps the seal the first row of jaws (crimping elements) releases the seal.

In an embodiment, a spring reopens the second row of jaws so as to free the seal and to ready jaws for the next operation only if the inward stroke has been completed. In this embodiment, the handle of the crimping device can make an inward stroke only when a full jaw-closing outward crimping stroke is completed. Not allowing the next operation until the inward stroke is complete is facilitated by a shaft being connected to a pair of lock arms, which unlocks the lever at the end of the inward stroke, and allows a spring to return the lever to an initial position in which the jaws are again open.

The result of closing each pair of crimping elements on different strokes is that the lever moves only one pair of jaws and the force needed to crimp the seal is divided between inward and outward strokes so that the operator feels as though less effort needs to be applied (by the operator) during the working cycle as a result of the reduction of force that needs to be applied to the handles to operate the two stroke crimping device. The spring of the crimping devices reopens the jaws and frees the seal only after the inward stroke has been completed and the second row of jaws (crimping elements) has finished the crimping operation, so the device is ready for the next cycle. The crimping device keeps all jaws open and the handles next to each other during the loading operation, which facilitates easy placing of the crimping device on the seal. Since all rows of jaws are open and the handles are next to each other when the operation cycle starts, it is easy to place the crimping device on the steel seal of the strap, which is tensioned and placed around the object.

Any of the above embodiments may be used alone or together with one another in any combination. Inventions encompassed within this specification may also include embodiments that are only partially mentioned or alluded to or are not mentioned or alluded to at all in this brief summary or in the abstract.

BRIEF DESCRIPTION OF THE DRAWINGS

In the following drawings like reference numbers are used to refer to like elements. Although the following figures depict various examples of the invention, the invention is not limited to the examples depicted in the figures.

FIG. 3*a* is a view of an embodiment of the first crimping element in the initial position. For better view, parts of the second crimping element are missing.

FIG. 3*b* is a view of an embodiment of the first crimping element in the intermediate position of the operating handle's outward stroke.

FIG. 3*c* is a view of an embodiment of the first crimping element at the end of the operating handle's outward stroke.

FIG. 4*a* is a cross-sectional view of an embodiment of the second crimping element in the initial position. For better view, parts of the first crimping element are missing.

FIG. 4*b* is a cross-sectional view of an embodiment of the second crimping element in the intermediate position of the of the operating handle's outward stroke.

FIG. 4*c* is a cross-sectional view of an embodiment of the second crimping element at the end of the operating handle's outward stroke.

FIG. 5*a-g* show an embodiment of collapsible arm for every position of the second crimping element shown on FIG. 4*a-g* respectively.

DETAILED DESCRIPTION

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Figure 1:
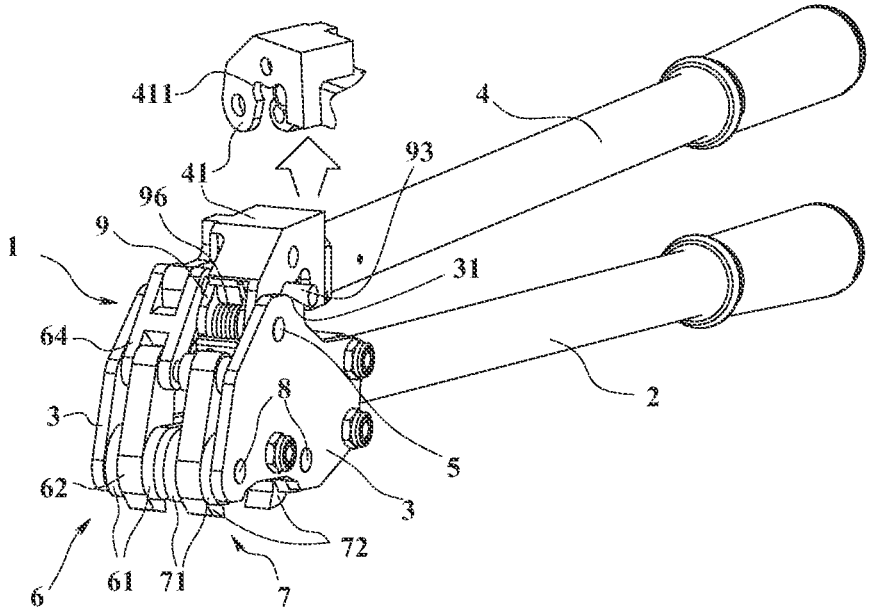
FIG. 1 is a perspective view of an embodiment of a two stroke crimping device in the initial position.
Figure 2:
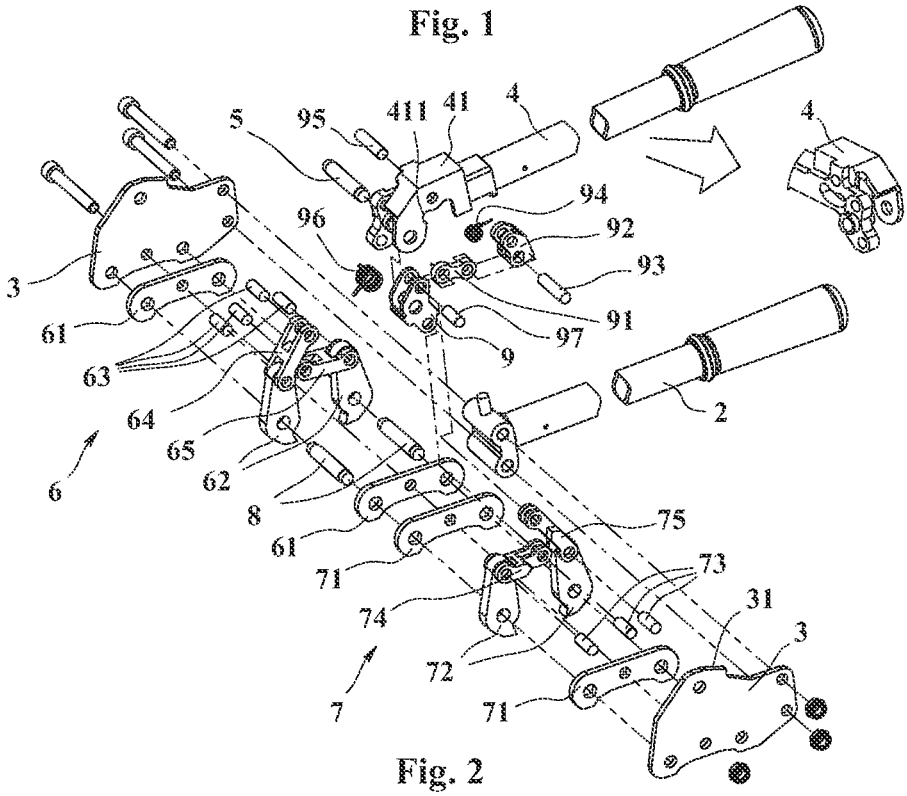
FIG. 2 is an exploded view of an embodiment of the crimping tool of FIG. 1.
Figure 4D:
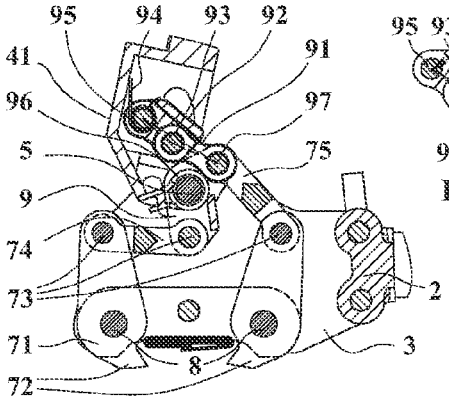
FIG. 4*d* is a cross-sectional view of an embodiment of the second crimping element in the intermediate position of the operating handle's inward stroke.
Figure 4E:
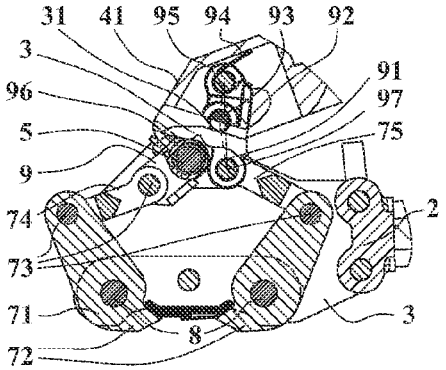
FIG. 4*e* is a cross-sectional view of an embodiment of the second crimping element in the position of initiation of unlock operation.
Figure 4F:
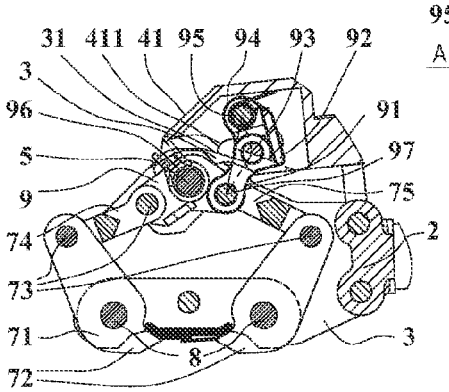
FIG. 4*f* is a cross-sectional view of an embodiment of the second crimping element at the end of the operating handle's inward stroke—unlock operation in progress.
Figure 5F:
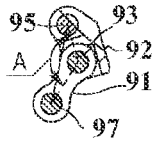

Referring first to FIG. 1 and FIG. 2, which show a crimping device constructed with a tool head 1 (FIG. 1), stationary handle 2 mounted on the housing 3, an operating handle 4 pivotally mounted on the housing 3 by a central pin 5, first crimping element 6 and second crimping element 7. First crimping element 6 includes at least a first an oppositely situated pair of jaws 62 pivotally held in place and sandwiched between a pair of shears 61. Second crimping element 7 includes at least a pair of shears 71 and an oppositely situated pair of jaws 72 pivotally held in place and sandwiched between a pair of shears 71. Both first and second crimping elements are secured in a housing 3 by shafts 8. Housing 3 has surface 31, which is discussed below in conjunction with FIGS. 4*e* and 4*f*. FIGS. 1 and 2 each show two views of the head 41 of operating handle 4.

Pins 63 connect the head 41 of operating handle 4 to first crimping element 6 by linkages 64 and 65. Operating handle 4 acts as a lever to directly cause linkages 64 and 65 to move as operating handle 4 moves. Pins 73 connect lever 9 to the second crimping element 7 by linkages 74 and 75. Moving lever 9 causes linkages 74 and 75 to move. Lever 9 is pivotally mounted on the housing 3 by a central pin 5. Two lock arms 91 and 92 are situated inside the head 41 of operating handle 4 and are connected to each other with lock pin 93 and also connected to the head 41 of operating handle 4 by pin 95, via lock arm 91 being pivotally mounted on pin 95, which is mounted on the head 41 of operating handle 4. Additionally, lock arms 91 and 92 are connected with lever 9 through pin 97, such that lock arm 91 is pivotally mounted on pin 97, which is mounted on lever 9. At the same time, lever 9 is connected with the head 41 of operating handle 4 through pins 93, 95, and 97 and lock arms 91 and 92. Lock spring 94 is located inside the lock arm 92 and is mounted on pin 95. In an embodiment, lock spring 94 is a coil spring. One of two ends of lock spring 94 presses on the head 41 of operating handle 4. Another end of the lock spring 94 pushes lock arm 92 against one end of lock arm 91 (the end of lock arm 91 that has pin 93 is the end that lock spring 94 pushes lock arm 92 against). Initially (that is in FIGS. 4*a-e*), as a result of the mechanical bias of lock spring 94 creates clockwise directional torque on lock arm 92 about pin 93. Main spring 96 is mounted on the central pin 5 and is located inside the lever 9. Main spring 96 creates counterclockwise directional torque on lever 9 against the head 41 of operating handle 4 as shown on FIG. 4*a-e*.

The operation of the crimping device is best understood by referring to FIGS. 3*a-g* and FIGS. 4*a-g*. FIGS. 3*a-g* are views of the first crimping element shown in different positions of the operating handle 4. FIGS. 4*a-g* is cross-sectional view of the second crimping element shown in different positions of the operating handle 4. The sequence of events represented by FIGS. 3*a-g* occur simultaneously with the sequence of events represented by FIGS. 4*a-g* and are characterized by the same position of the handle. That is, each of the positions of FIGS. 3*a-g* occurs at the same handle position as the corresponding one of FIGS. 4*a-g*, respectively. It should be noted that due to the fact that jaws 62 and 72 are open and handles 2 and 4 are next to each other in the beginning of the operation cycle, it is easy to position the crimping device on the steel seal after strap is tensioned around the object.

The operator begins the operation cycle with the crimping device positioned on the seal, as shown on FIGS. 3*a* and 4*a*. After placing the crimping device on the seal, the operator pivots operating handle 4 about pin 5 upwards while holding the stationary handle 2 (or rotates operating handle 4 away from stationary handle 2). The rotating of operating handle 4 away from stationary handle 2 may be referred to as the "outward crimping stroke," and the rotating of operating handle 4 towards stationary handle 2 may be referred to as the "inward crimping stroke."

During the outward crimping stroke, jaws 62 of the first crimping element 6 cut the seal along with two ends of the tensioned strap inside the seal as jaws 62 are directly connected with the head 41 of operating handle 4 through pins 63 by linkages 64 and 65 as shown on FIG. 3*b*. At the same time, jaws 72 of second crimping element 7 and lever 9 remain stationary while the position of lock arms 91 and 92 changes as shown on FIGS. 4*a-c* and FIGS. 5*a-c*.

During the outward crimping stroke, main spring 96 becomes more and more compressed as the operating handle 4 is moved further from stationary handle 2. During the outward crimping stroke, main spring 96 pushes the head 41 of operating handle 4 away from linkage 74 with a larger and larger force as main spring 96 is compressed, but the force from main spring 96 is easily overcome by the operator of operating handle 4, resulting in main spring 96 becoming more compressed at the end of the outward crimping stroke than at any other time during the two stroke crimping process, and main spring 96 remains in this compressed state throughout the remainder of the outward crimping stroke and much of the inward crimping stroke. During the outward crimping, the result of main spring 96 pushing linkage 74 away from operating handle 4 is a downward force on pin 73, which pulls on the end of lever 9 that has pin 73, creating a torque in the counterclockwise direction (with respect to pin 5) on lever 9, which holds pair of jaws 72 in an open position.

Figure 5D:
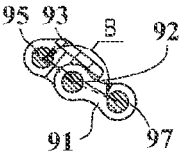
Figure 5E:
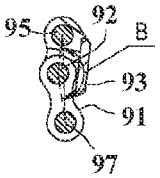
Figure 3F:
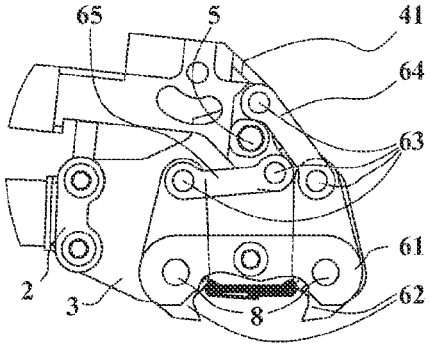
FIG. 3*f* is a view of an embodiment of the first crimping element at the end of operating handle's inward stroke—(unlock operation in progress).

While in the position of FIGS. 4*a* and 5*a*, lock arms 91 and 92 form a collapsible arm 98 that is folded to the greatest extent that the arm formed by lock arms 91 and 92 is folded during the two stroke crimping. In FIG. 5*a* lock arms 91 and 92 form an acute angle A facing rightwards. As the outward stroke crimping progresses, the angle A between lock arms 91 and 92 increases. Initially the collapsible arm 98 formed by lock arms 91 and 92 straightens until a position somewhere between that shown in FIGS. 5*b* and 5*c*. In FIGS. 5*c*-5*e*, the angle B made by lock arms 91 and 92 is an oblique angle that faces the opposite direction, with respect to operating handle 4, as the angle A of FIGS. 5*a* and 5*b*. While in the position shown in FIG. 4*a*, lock spring 94 pushes lock arm 92 to rotate clockwise about pin 93.

While in the position of FIG. 5*c*, since lock arm 91 has changed the angle A to angle B that lock arm 91 makes with lock arm 92, now collapsible arm 98 pushes on lever 9 creating a torque in a clockwise direction, which would tend to close jaws 72. However, main spring 96 still pushes lever 9 to rotate in a counterclockwise direction working against lock spring 94, and since main spring 96 is stronger than lock spring 94, the net result is a force pushing lever 9 in a counter clockwise direction holding jaws 72 open.

At the end of the outward crimping stroke, when jaws 62 of the first crimping element 6 finish the strap crimping operation (which may result in cutting the seal), as shown on FIG. 3*c*, the lock spring 94, via lock arm 92, moves the pin 93 to lock arm 92's end position where lock arm 92 is pressed (by lock spring 94) against the surface 411 (FIG. 4*b*) of the head 41 of the operating handle 4, as shown on FIG. 4*c*. Lock spring 94 holds the collapsible arm 98 formed by lock arms 91 and 92 in the angle B, mentioned above, that faces the opposite direction as the angle A made by lock arms 91 and 92 shown in FIGS. 4*a* and 4*b*.

Figure 3D:
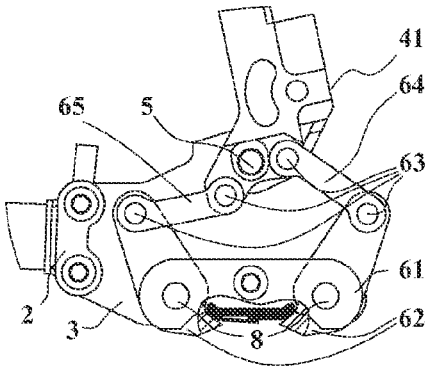
FIG. 3*d* is a view of an embodiment of the first crimping element in the intermediate position of the operating handle's inward stroke.

The inward crimping stroke begins after the outward cycle is finalized and the operator begins moving the operating handle 4 back toward the stationary handle 2, as shown in FIG. 3*d* and FIG. 4*d*.

Figure 3E:
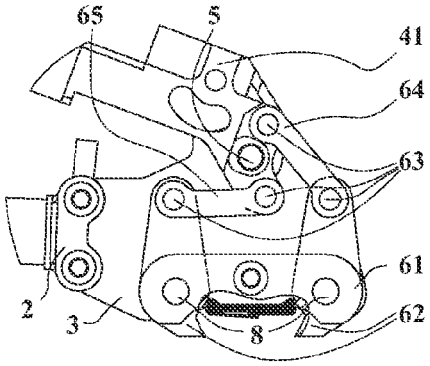
FIG. 3*e* is a view of an embodiment of the first crimping element in the initial position of unlock operation.
Figure 3G:
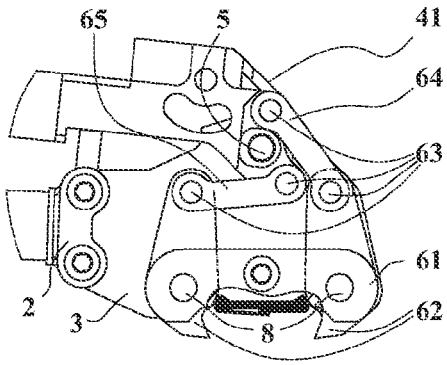
FIG. 3*g* is a view of an embodiment of the first crimping element at the end of the operating handle's inward stroke and at the end of unlock operation—initial position for the next cycle.
Figure 4G:
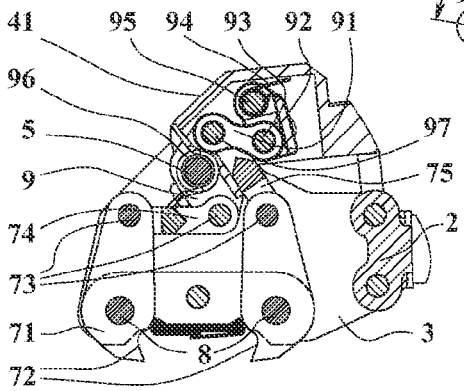
FIG. 4*g* is a cross-sectional view of an embodiment of the second crimping element at the end of the operating handle's inward stroke at the end of unlock operation—initial position for the next cycle.
Figure 5G:
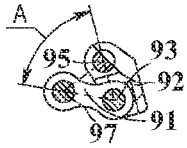

During the inward crimping stroke, jaws 72 of the second crimping element 7 make the second cut of the seal while jaws 62 of first crimping element 6 are opening up and releasing the seal (FIG. 3*d* and FIG. 3*e*). Lever 9 moves with the head 41 of operating handle 4 without compressing the lock spring 94. After loading main spring 96, lock spring 94 remains uncompressed and main spring 96 remains compressed until lock arms 91 and 92 unlock. During the inward crimping stroke, lock arms 91 and 92 remain locked in place as a result of lock spring 94 pushing pin 93 into surface 411 of the head 41 of operating handle 4 until just after the position of FIG. 4*e*. As a result of lock arms 91 and 92 being locked in position, the combination of lock arms 91 and 92 act as one collapsible arm 98, such that as the inward stroke progresses from the position of FIG. 4*c* until the position of FIG. 4*e*, and the combination of lock arms 91 and 92 transfers the force exerted by the operator from operating handle 4, via the combination of lock arms 91 and 92, to the side of lever 9 having pin 97, causing lever 9 to rotate clockwise about pin 5, thereby closing jaws 72. At the end of the inward stroke (FIG. 4*e*), although the force from handle 4 would still push lock arm 92 into lock arm 91 (and thereby would push jaws 72 closed), pin 93 engages surface 31 (FIGS. 2, 4*e* and 4*f*) of the housing 3 that is shaped to be sloped downward towards the right in FIG. 4*d*, so that a component of the downward force on pin 93 is perpendicular to surface 31, but pointing to the right in FIG. 4*e*, which unlocks lock arms 91 and 92 (collapses collapsible arm 98). Consequently, since the torque of the lock spring 94 is inferior to the torque of the main spring 96 and, at a certain point, (FIG. 40 the main spring 96 rotates the lever 9 counterclockwise and opens up jaws 72 of the second crimping element 7, until main spring 96, lever 9, lock arm 91 and lock arm 92 return to essentially the initial position FIG. 4*g* (it may be necessary to further close operating handle 4, slightly, to fully return to the initial open position of FIG. 4*g*). The further closing of the operating handle 4 and stationary handle 2 also returns jaws 62 of first crimping element 6 to the initial open position as well (FIG. 3*g*). After the crimping device has been returned to its initial position (as shown in FIGS. 3*g* and 4*g*), the crimping device can be taken away from the secured seal and ready to the next operating cycle and secure another seal in another location.

A feature of the crimping device is that it requires less force to be applied by the operator than were both rows of crimping elements closed simultaneously due to presence of an idle row of jaws on each stroke of working cycle. Another feature of the crimping device is all full jaw-closing crimping strokes are ensured to be completed. Another feature of the crimping device is that jaws automatically reopen at the end of the crimping operation.

Each embodiment disclosed herein may be used or otherwise combined with any of the other embodiments disclosed. Any element of any embodiment may be used in any embodiment.

Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

The invention claimed is:

1. A device comprising:

at least a first pair of jaws;

an operating handle connected to the first pair jaws, which closes the first pair of jaws when rotated in a first direction of rotation of the operating handle, and opens the first pair of jaws when rotated in a second direction of rotation of the operating handle;

a second pair of jaws;

a lever connected to the second pair of jaws, which remains stationary when rotated in a first direction of rotation of the operating handle, and closes the second pair of jaws when rotated in a second direction of rotation of the operating handle;

a collapsible linkage linking the lever to the operating handle, the collapsible linkage having a joint that allows the linkage to collapse and the operating handle to be rotated in the first direction of rotation without moving the second pair of jaws from the open position as a result of the collapsible linkage being collapsed; and at least one mechanical bias, the collapsible linkage being mechanically biased via the at least one mechanical bias to cause the second pair of jaws to close when the operating handle is rotated in the second direction from a configuration in which the first pair of jaws is closed and the second pair of jaws is open.

2. The device of claim 1, the collapsible linkage including at least a first arm pivotally connected to a second arm, the first arm being pivotally linked to the operating handle and the second arm being pivotally linked to the lever.

3. The device of claim 2, the at least one mechanical bias including at least a first mechanical bias and a second mechanical bias, the first mechanical bias biasing the first arm to rotate in the second direction of rotation of the operating handle; and the second mechanical bias biasing the lever to rotate in the first direction of rotation of the operating handle.

4. The device of claim 1 further comprising a surface that engages the joint while the operating handle is rotating in the second direction of rotation of the operating handle, therein causing the joint to collapse into a configuration that the collapsible linkage was initially positioned at a start of moving the operating handle in the first direction of rotation of the operating handle.

5. A method comprising:

placing a device into an initial position, the device having at least an operating handle and a plurality of pairs of jaws, while in the initial position of the plurality of pairs of jaws being open;

rotating the operating handle in a first direction, the rotating of the operating handle in the first direction causing at least a first pair of jaws of the at least two pairs of jaws to close without closing at least a second pair of jaws of the at least two pairs of jaws;

after rotating the operating handle in the first direction, rotating the operating handle in a second direction, the rotating of the operating handle in the second direction causing the at least second pair of jaws to close.

6. The method of claim 5, the rotating of the operating handle in the second direction causing the at least first pair of jaws to open; the method further comprising:

after causing the at least second pair of jaws to close, the second pair of jaws automatically opening, resulting in the method reaching completion with the plurality of pairs of jaws open.

* * * * *